US009923263B2

(12) United States Patent
Yen et al.

(10) Patent No.: US 9,923,263 B2
(45) Date of Patent: Mar. 20, 2018

(54) MOBILE DEVICE

(71) Applicant: Acer Incorporated, New Taipei (TW)

(72) Inventors: Ming-Ching Yen, New Taipei (TW); Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 28 days.

(21) Appl. No.: 15/089,201

(22) Filed: Apr. 1, 2016

(65) Prior Publication Data

US 2017/0264002 A1 Sep. 14, 2017

(30) Foreign Application Priority Data

Mar. 9, 2016 (TW) ..... 105107161 A

(51) Int. Cl.

| | |
|---|---|
| ***H01Q 1/38*** | (2006.01) |
| ***H01Q 1/24*** | (2006.01) |
| ***H01Q 1/48*** | (2006.01) |
| ***H01Q 9/26*** | (2006.01) |
| ***H01Q 9/04*** | (2006.01) |
| ***H01Q 9/42*** | (2006.01) |

(52) U.S. Cl.

CPC ..... *H01Q 1/243* (2013.01); *H01Q 1/24* (2013.01); *H01Q 1/48* (2013.01); *H01Q 9/0421* (2013.01); *H01Q 9/26* (2013.01); *H01Q 9/42* (2013.01)

(58) Field of Classification Search

USPC ..... 343/702, 700 MS

See application file for complete search history.

(56) References Cited

U.S. PATENT DOCUMENTS

| | | | | |
|---|---|---|---|---|
| 6,765,536 | B2 | 7/2004 | Phillips et al. | |
| 7,136,022 | B2 * | 11/2006 | Sato | H01Q 9/26 343/702 |
| 2005/0073462 | A1 * | 4/2005 | Lin | G06F 1/1616 343/702 |
| 2005/0093750 | A1 | 5/2005 | Vance | |
| 2005/0168384 | A1 | 8/2005 | Wang et al. | |

(Continued)

FOREIGN PATENT DOCUMENTS

CN 203967235 U 11/2014

OTHER PUBLICATIONS

Chinese language office action dated May 9, 2017, issued in application No. TW 105107161.

*Primary Examiner* — Jessica Han
*Assistant Examiner* — Hai Tran
(74) *Attorney, Agent, or Firm* — McClure, Qualey & Rodack, LLP

(57) ABSTRACT

A mobile device includes a ground element and an antenna structure. The antenna structure includes a feeding connection element, a first radiation element, a second radiation element, a shorting element, and a parasitic radiation element. The feeding connection element is coupled to a signal source. The first radiation element is coupled to the feeding connection element. The first radiation element has an open end. The second radiation element is coupled to the feeding connection element. The second radiation element has an open end. The feeding connection element is coupled through the shorting element to the ground element. The parasitic radiation element is adjacent to the second radiation element.

8 Claims, 6 Drawing Sheets

(56) References Cited

U.S. PATENT DOCUMENTS

| | | | | |
|---|---|---|---|---|
| 2009/0295669 | A1* | 12/2009 | Su | H01Q 1/48 343/846 |
| 2011/0012794 | A1* | 1/2011 | Schlub | H01Q 1/243 343/702 |
| 2014/0361945 | A1 | 12/2014 | Misra et al. | |

* cited by examiner

MOBILE DEVICE

CROSS REFERENCE TO RELATED APPLICATIONS

This Application claims priority of Taiwan Patent Application No. 105107161 filed on Mar. 9, 2016, the entirety of which is incorporated by reference herein.

BACKGROUND OF THE INVENTION

Field of the Invention

The disclosure generally relates to a mobile device, and more particularly, to a mobile device including a low-profile antenna structure.

Description of the Related Art

With advancements in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Generally, current Wi-Fi system antennas have a total height from 8 mm to 10 mm. However, there is limited inner space in mobile devices. Thus, it has become a critical challenge for antenna designers to design a low-profile, small-size antenna structure.

BRIEF SUMMARY OF THE INVENTION

In a preferred embodiment, the invention is directed to a mobile device including a ground element and an antenna structure. The antenna structure includes a feeding connection element, a first radiation element, a second radiation element, a shorting element, and a parasitic radiation element. The feeding connection element has a first end and a second end. The first end of the feeding connection element is coupled to a signal source. The first radiation element has a first end and a second end. The first end of the first radiation element is coupled to the second end of the feeding connection element, and the second end of the first radiation element is open. The second radiation element has a first end and a second end. The first end of the second radiation element is coupled to the second end of the feeding connection element, and the second end of the second radiation element is open. The shorting element has a first end and a second end. The first end of the shorting element is coupled to the first end of the feeding connection element, and the second end of the shorting element is coupled to the ground element. The parasitic radiation element is adjacent to the second end of the second radiation element.

In some embodiments, the parasitic radiation element is float and separate from all of the other elements, including the ground element, the feeding connection element, the first radiation element, the second radiation element, and the shorting element.

In some embodiments, the parasitic radiation element has at least one right-angle bend.

In some embodiments, the parasitic radiation element has an L-shape or an N-shape.

In some embodiments, the first end of the feeding connection element is a feeding point, and the second end of the shorting element is a grounding point. The distance between the feeding point and the grounding point is from 2 mm to 5 mm.

In some embodiments, each of the feeding connection element, the first radiation element, and the second radiation element has a straight-line shape, and the shorting element has an L-shape.

In some embodiments, the feeding connection element and the first radiation element form a first resonant path, and the first resonant path is excited to generate a first frequency band from 2400 MHz to 2500 MHz.

In some embodiments, the feeding connection element, the second radiation element, and the parasitic radiation element form a second resonant path, and the second resonant path is excited to generate a second frequency band from 5150 MHz to 5850 MHz.

In some embodiments, the mobile device further includes a metal back cover. The metal back cover has a nonconductive antenna window. The nonconductive antenna window at least covers the vertical projections of the first radiation element, the second radiation element, and the parasitic radiation element.

In some embodiments, the total height of the nonconductive antenna window is from 2.5 mm to 3 mm, and the total height of the antenna structure is from 3 mm to 5 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Figure 1:
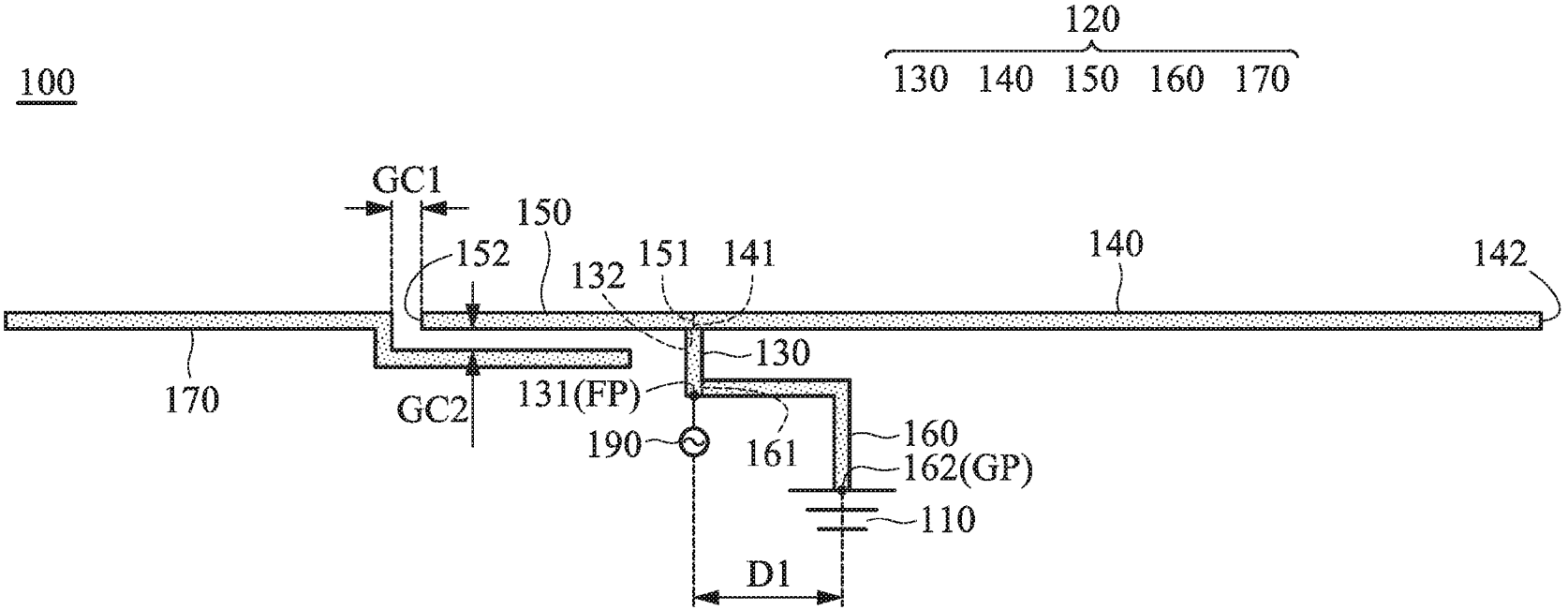
FIG. 1 is a diagram of a mobile device according to an embodiment of the invention.

FIG. 1 is a diagram of a mobile device 100 according to an embodiment of the invention. The mobile device 100 may be a smartphone, a tablet computer, or a notebook computer. As shown in FIG. 1, the mobile device 100 at least includes a ground element 110 and an antenna structure 120. The ground element 110 may be a ground metal plane, such as a ground copper. The antenna structure 120 may be made of a conductive material, such as copper, silver, aluminum, iron, or their alloys. The antenna structure 120 may be disposed on a dielectric substrate, such as an FR4 (Flame Retardant 4) substrate. It should be understood that the mobile device 100 may further include other components, such as a processor, a speaker, a touch control panel, a battery, and a housing although they are not displayed in FIG. 1.

The antenna structure 120 includes a feeding connection element 130, a first radiation element 140, a second radiation element 150, a shorting element 160, and a parasitic radiation element 170. The feeding connection element 130 may have a straight-line shape. The feeding connection element 130 has a first end 131 and a second end 132. The first end 131 of the feeding connection element 130 is a feeding point FP coupled to a signal source 190. The signal source 190 may be an RF (Radio Frequency) module for exciting the antenna structure 120. The first radiation element 140 may have a straight-line shape, which is perpendicular to the feeding connection element 130. The first radiation element 140 has a first end 141 and a second end 142. The first end 141 of the first radiation element 140 is coupled to the second end 132 of the feeding connection element 130. The second end 142 of the first radiation element 140 is open. The second radiation element 150 may have a straight-line shape, which is perpendicular to the feeding connection element 130. The second radiation element 150 has a first end 151 and a second end 152. The first end 151 of the second radiation element 150 is coupled to the second end 132 of the feeding connection element 130. The second end 152 of the second radiation element 150 is open. The length of the first radiation element 140 may be longer than the length of the second radiation element 150. For example, the length of the first radiation element 140 may be 2 to 3 times the length of the second radiation element 150. The second end 142 of the first radiation element 140 extends away from the second end 152 of the second radiation element 150. The shorting element 160 may have an L-shape. The shorting element 160 has a first end 161 and a second end 162. The first end 161 of the shorting element 160 is coupled to the first end 131 of the feeding connection element 130. The second end 162 of the shorting element 160 is a grounding point GP coupled to the ground element 110. The feeding point FP and the grounding point GP of the antenna structure 120 are close to each other. For example, the distance D1 between the feeding point FP and the grounding point GP may be from 2 mm to 5 mm. According to practical measurements, the aforementioned range of the distance D1 helps to reduce the total height of the antenna structure 120. The parasitic radiation element 170 may have at least one right-angle bend. For example, the parasitic radiation element 170 may have an N-shape. The parasitic radiation element 170 is adjacent to the second end 152 of the second radiation element 150. The parasitic radiation element 170 is float and separate from all of the other elements, including the ground element 110, the feeding connection element 130, the first radiation element 140, the second radiation element 150, and the shorting element 160. A first coupling gap GC1 is formed between the parasitic radiation element 170 and the second end 152 of the second radiation element 150. The width of the first coupling gap GC1 is from 0.75 mm to 1.25 mm. A second coupling gap GC2 is formed between the parasitic radiation element 170 and a median portion of the second radiation element 150. The width of the second coupling gap GC2 is from 0.5 mm to 1 mm. According to practical measurements, the aforementioned width range of the first coupling gap GC1 and the second coupling gap GC2 can enhance the mutual coupling between the parasitic radiation element 170 and the second radiation element 150.

In some embodiments, the operation theory of the antenna structure 120 is as follows. The feeding connection element 130 and the first radiation element 140 form a first resonant path, and the first resonant path is excited to generate a first frequency band from 2400 MHz to 2500 MHz. The total length of the feeding connection element 130 and the first radiation element 140 is approximately equal to 0.25 wavelength of the first frequency band. In addition, the feeding connection element 130, the second radiation element 150, and the parasitic radiation element 170 form a second resonant path, and the second resonant path is excited to generate a second frequency band from 5150 MHz to 5850 MHz. The parasitic radiation element 170 is excited by the second radiation element 150 through the mutual coupling therebetween. The total length of the feeding connection element 130 and the second radiation element 150 is approximately equal to 0.25 wavelength of the second frequency band. Accordingly, the antenna structure 120 can cover the dual-band operation of WLAN (Wireless Local Area Network) 2.4 GHz/5 GHz.

Figure 2:
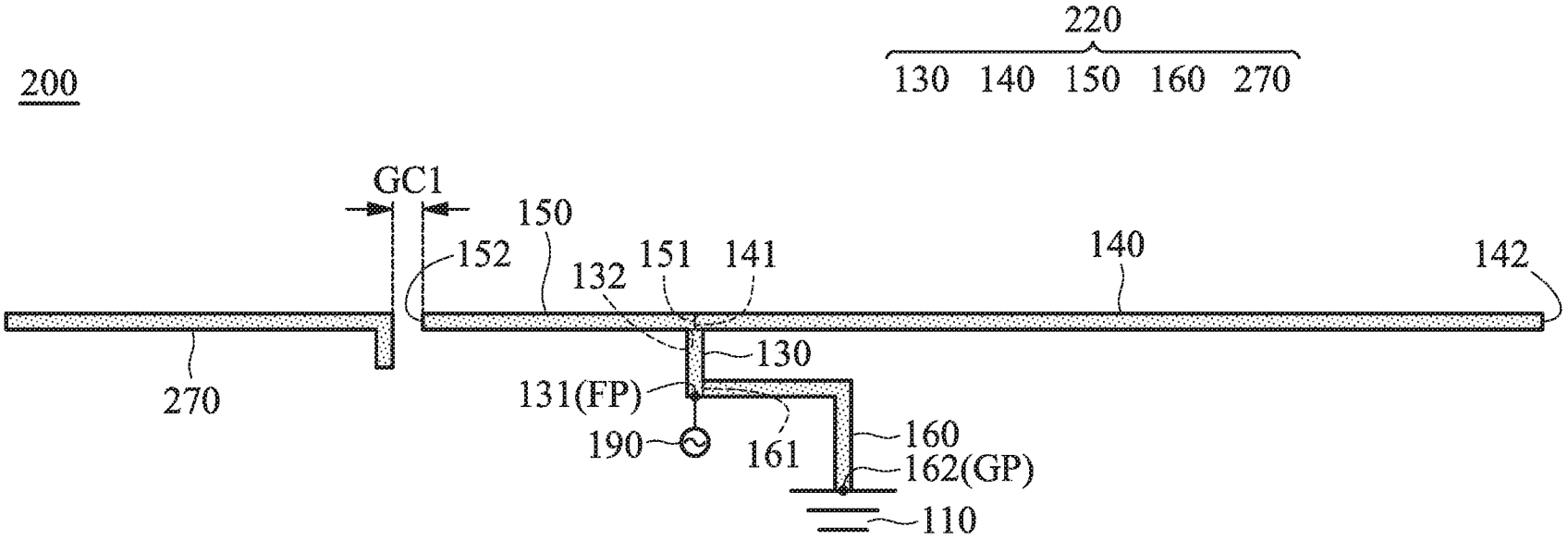
FIG. 2 is a diagram of a mobile device according to an embodiment of the invention.

FIG. 2 is a diagram of a mobile device 200 according to an embodiment of the invention. FIG. 2 is similar to FIG. 1. In the embodiment of FIG. 2, an antenna structure 220 of the mobile device 200 includes a parasitic radiation element 270 which has an L-shape. The parasitic radiation element 270 is adjacent to the second end 152 of the second radiation element 150. The parasitic radiation element 270 is float and separate from all of the other elements, including the ground element 110, the feeding connection element 130, the first radiation element 140, the second radiation element 150, and the shorting element 160. A first coupling gap GC1 is formed between the parasitic radiation element 270 and the second end 152 of the second radiation element 150. The width of the first coupling gap GC1 is from 0.75 mm to 1.25 mm. Other features of the mobile device 200 of FIG. 2 are similar to those of the mobile device 100 of FIG. 1. Accordingly, the two embodiments have similar levels of performance.

Figure 3:
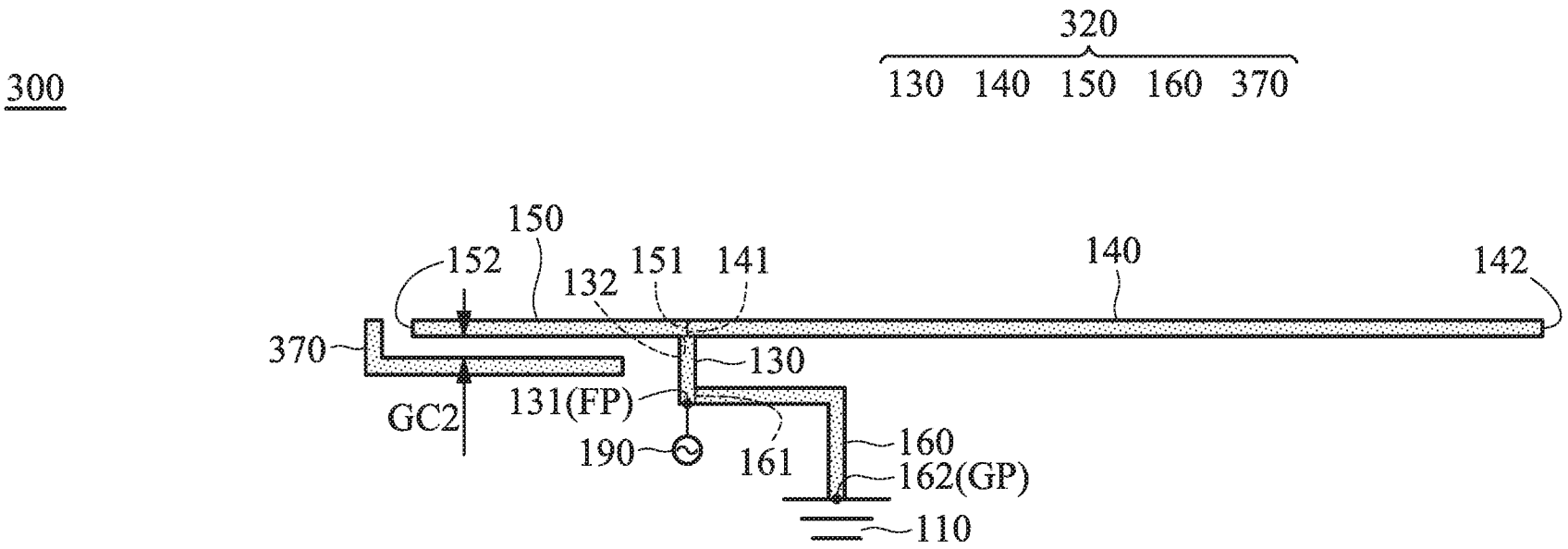
FIG. 3 is a diagram of a mobile device according to an embodiment of the invention.

FIG. 3 is a diagram of a mobile device 300 according to an embodiment of the invention. FIG. 3 is similar to FIG. 1. In the embodiment of FIG. 3, an antenna structure 320 of the mobile device 300 includes a parasitic radiation element 370 which has an L-shape. The parasitic radiation element 370 is adjacent to the median portion of the second radiation element 150. The parasitic radiation element 370 is float and separate from all of the other elements, including the ground element 110, the feeding connection element 130, the first radiation element 140, the second radiation element 150, and the shorting element 160. A second coupling gap GC2 is formed between the parasitic radiation element 370 and the median portion of the second radiation element 150. The width of the second coupling gap GC2 is from 0.5 mm to 1 mm. Other features of the mobile device 300 of FIG. 3 are similar to those of the mobile device 100 of FIG. 1. Accordingly, the two embodiments have similar levels of performance.

Figure 4:
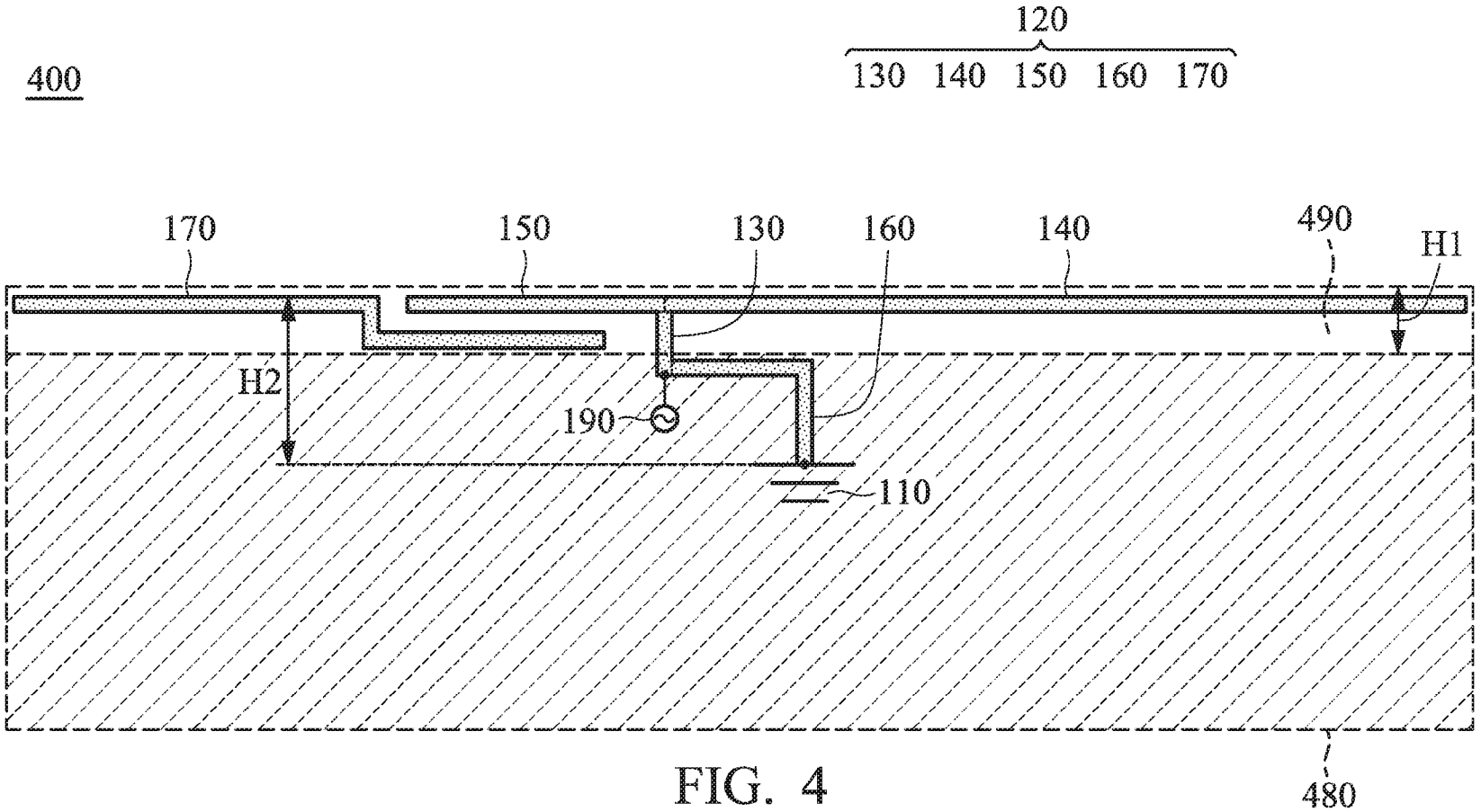
FIG. 4 is a diagram of a mobile device according to an embodiment of the invention.

FIG. 4 is a diagram of a mobile device 400 according to an embodiment of the invention. FIG. 4 is similar to FIG. 1. In the embodiment of FIG. 4, the mobile device 400 further includes a metal back cover 480. The metal back cover 480 is adjacent to the antenna structure 120, and it may be in front or back of the antenna structure 120. A nonconductive antenna window 490 is formed on the metal back cover 480. The nonconductive antenna window 490 is aligned with the antenna structure 120, and therefore the radiation energy of the antenna structure 120 can be transmitted through the nonconductive antenna window 490. With the nonconductive antenna window 490, the metal back cover 480 does not tend to negatively affect the radiation pattern of the antenna structure 120 nearby. Specifically, the antenna structure 120 has a vertical projection on the metal back cover 480. The nonconductive antenna window 490 at least covers the vertical projections of the first radiation element 140, the second radiation element 150, and the parasitic radiation element 170. According to practical measurements, if the total height H1 of the nonconductive antenna window 490 is from 2.5 mm to 3 mm and the total height H2 of the antenna structure 120 is from 3 mm to 5 mm, the antenna structure 120 can generate good radiation efficiency in the desired frequency band. Other features of the mobile device 400 of FIG. 4 are similar to those of the mobile device 100 of FIG. 1. Accordingly, the two embodiments have similar levels of performance.

Figure 5:
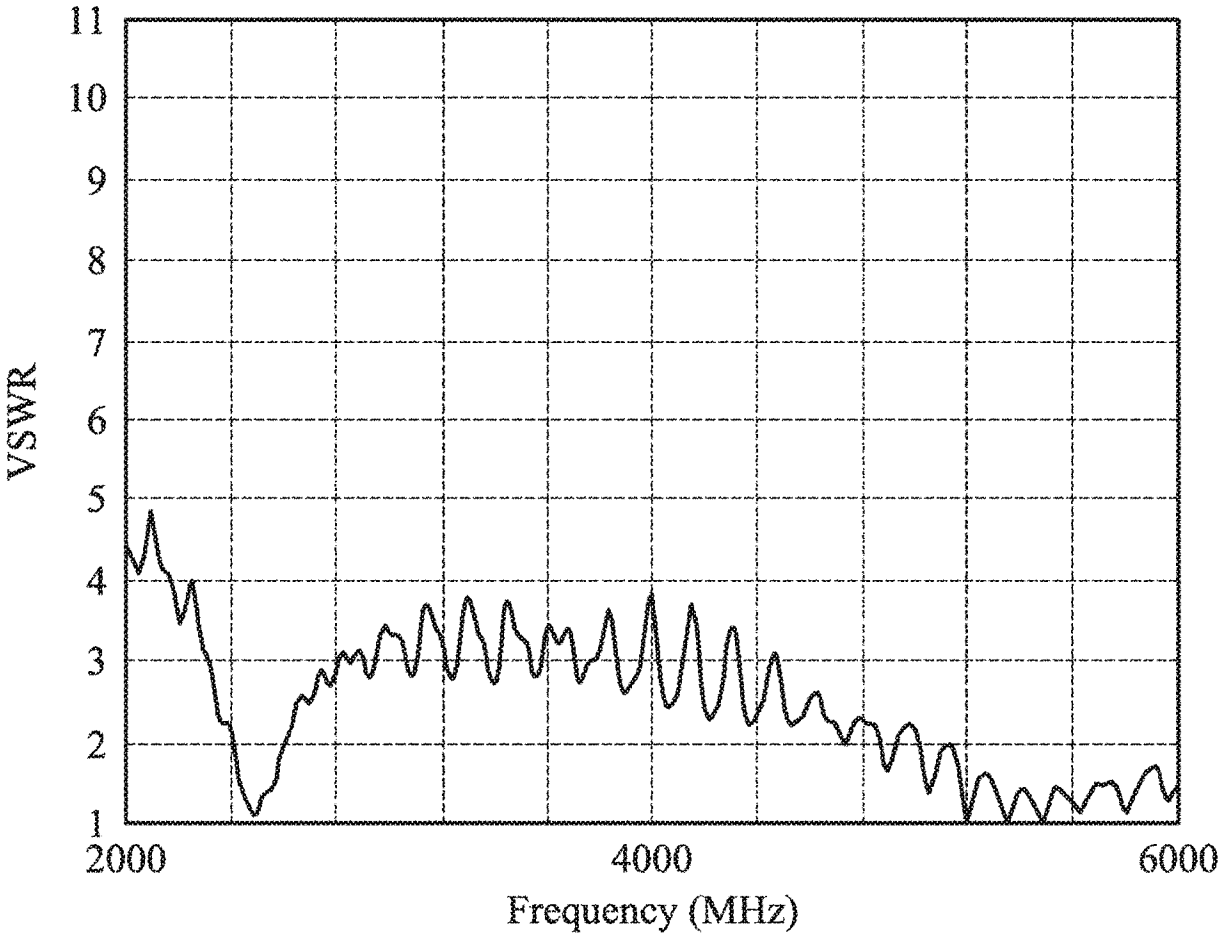
FIG. 5 is a diagram of VSWR (Voltage Standing Wave Ratio) of an antenna structure of a mobile device according to an embodiment of the invention.

FIG. 5 is a diagram of VSWR (Voltage Standing Wave Ratio) of the antenna structure 120 of the mobile device 400 according to an embodiment of the invention. The horizontal axis represents the operation frequency (MHz), and the vertical axis represents the VSWR. According to the measurement of FIG. 5, when the antenna structure 120 is excited, its radiation energy is transmitted through the nonconductive antenna window 490. At this time, the antenna structure 120 can at least cover the first frequency band from 2400 MHz to 2500 MHz, and the second frequency band from 5150 MHz to 5850 MHz.

Figure 6:
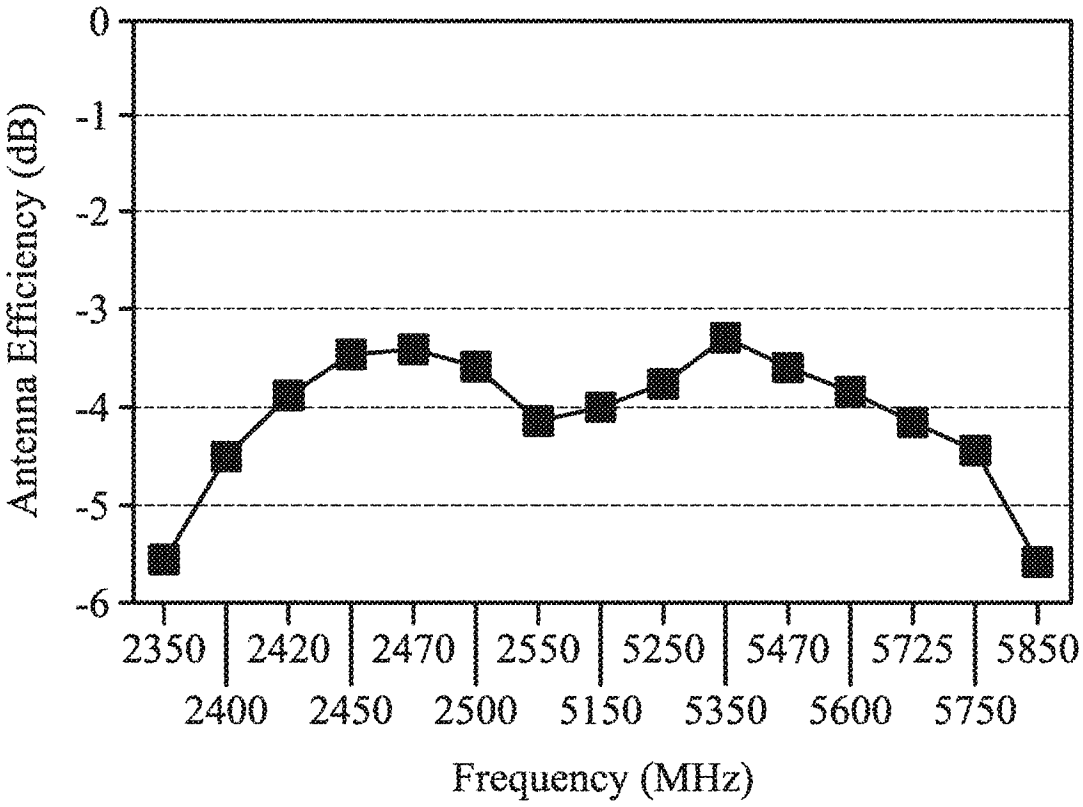
FIG. 6 is a diagram of antenna efficiency of an antenna structure of a mobile device according to an embodiment of the invention.

FIG. 6 is a diagram of antenna efficiency of the antenna structure 120 of the mobile device 400 according to an embodiment of the invention. The horizontal axis represents the operation frequency (MHz), and the vertical axis represents the antenna efficiency (dB). According to the measurement of FIG. 6, when the antenna structure 120 is excited, its antenna efficiency is higher than −5 dB over the first frequency band and the second frequency band. This antenna efficiency can meet the requirement of practical applications of mobile communication.

The invention proposes a novel mobile device and a low-profile antenna structure therein. The total height of the antenna structure is from 3 mm to 5 mm. In comparison to the conventional design, the invention can reduce the size of the antenna structure by 50% or more. Accordingly, it is suitable for application in a variety of small-size mobile communication device.

Note that the above element sizes, element shapes, and frequency ranges are not limitations of the invention. An antenna designer can fine-tune these settings or values according to different requirements. It should be understood that the mobile device and the antenna structure of the invention are not limited to the configurations of FIGS. 1-6. The invention may include any one or more features of any one or more embodiments of FIGS. 1-6. In other words, not all of the features displayed in the figures should be implemented in the mobile device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

a ground element; and an antenna structure, comprising:

a feeding connection element, having a first end and a second end, wherein the first end of the feeding connection element is coupled to a signal source;

a first radiation element, having a first end and a second end, wherein the first end of the first radiation element is coupled to the second end of the feeding connection element, and the second end of the first radiation element is open;

a second radiation element, having a first end and a second end, wherein the first end of the second radiation element is coupled to the second end of the feeding connection element, and the second end of the second radiation element is open;

a shorting element, having a first end and a second end, wherein the first end of the shorting element is coupled to the first end of the feeding connection element, and the second end of the shorting element is coupled to the ground element; and a parasitic radiation element, adjacent to the second end of the second radiation element;

wherein the mobile device further comprises:

a metal back cover, having a nonconductive antenna window, wherein the nonconductive antenna window at least covers vertical projections of the first radiation element, the second radiation element, and the parasitic radiation element;

wherein a total height of the nonconductive antenna window is from 2.5 mm to 3 mm, and a total height of the antenna structure is from 3 mm to 5 mm.

2. The mobile device as claimed in claim 1, wherein the parasitic radiation element is float and separate from the ground element, the feeding connection element, the first radiation element, the second radiation element, and the shorting element.

3. The mobile device as claimed in claim 1, wherein the parasitic radiation element has at least one right-angle bend.

4. The mobile device as claimed in claim 1, wherein the parasitic radiation element has an L-shape or an N-shape.

5. The mobile device as claimed in claim 1, wherein the first end of the feeding connection element is a feeding point, the second end of the shorting element is a grounding point, and a distance between the feeding point and the grounding point is from 2 mm to 5 mm.

6. The mobile device as claimed in claim 1, wherein each of the feeding connection element, the first radiation element, and the second radiation element has a straight-line shape, and the shorting element has an L-shape.

7. The mobile device as claimed in claim 1, wherein the feeding connection element and the first radiation element form a first resonant path, and the first resonant path is excited to generate a first frequency band from 2400 MHz to 2500 MHz.

8. The mobile device as claimed in claim 1, wherein the feeding connection element, the second radiation element, and the parasitic radiation element form a second resonant path, and the second resonant path is excited to generate a second frequency band from 5150 MHz to 5850 MHz.

* * * * *